United States Patent [19]

Sato et al.

[11] 4,382,835

[45] May 10, 1983

[54] COMPOSITE LABEL ARRANGING DEVICE

[75] Inventors: Yo Sato, Tokyo; Norio Abe, Kitagami; Suguru Kikuchi, Ezurikomura; Fumio Goto, Kitagami; Akira Sugimoto, Koshijimachi, all of Japan

[73] Assignee: Kabushiki Kaisha Sato, Japan

[21] Appl. No.: 265,914

[22] Filed: May 21, 1981

[30] Foreign Application Priority Data

Jun. 6, 1980 [JP] Japan ..... 55-78103

[51] Int. Cl.[3] ..... B65C 11/02

[52] U.S. Cl. ..... 156/384; 101/288; 101/291; 156/541; 156/577; 156/579; 156/584; 156/DIG. 49

[58] Field of Search ..... 156/384, 541, 577, 579, 156/584, DIG. 33, DIG. 48, DIG. 49; 101/288, 291, 292

[56] References Cited

U.S. PATENT DOCUMENTS 4,197,799 4/1980 Sato ..... 101/288

4,224,872 9/1980 Sato ..... 156/384

*Primary Examiner*—Michael G. Wityshyn

*Attorney, Agent, or Firm*—Ostrolenk, Faber, Gerb & Soffen

[57] ABSTRACT

A composite label arranging device is disclosed wherein a composite label having a layer of label material superposed on a layer of backing material, with feed flaps formed in both layers, is engaged with feed pins of a feed roller, by which the feed flaps are forced upright. The feed roller intermittently rotates in synchronism with the operation of a hand lever for advancement of the label on a platen. A label arranging member is disposed in opposition to the platen so as to descend during the squeezing operation of the hand lever and press against and thereby flatten the upright flaps.

18 Claims, 11 Drawing Figures

COMPOSITE LABEL ARRANGING DEVICE

BACKGROUND OF THE INVENTION

The present invention relates to a composite label arranging device for flattening upstanding feed hole flaps of a composite label. More particularly, the present invention relates to an improvement in a composite label arranging device for a portable label printing machine.

The composite label with which the device is used consists of an underlying tape-like strip of backing material and an overlying layer of label material cut into predetermined lengths, wherein feed flaps are formed along the longitudinal direction of both these layers of material. The composite label is applied to the P.S.P. (push-separate-pull) system label printing machine. Feed pins arranged on the surface of a feed roller engage the feed flaps so that the composite label is advanced at a predetermined pitch toward a platen by the intermittent rotation of the feed roller. The feed roller is intermittently rotated during releasing of a hand lever of the labeling machine, following the squeezing of the hand lever. Feed flaps in the label are made to stand upright by engagement with the feed pins of the feed roller. The arranging device flattens the upstanding feed flaps.

The label pieces are printed on the platen while being temporarily supported there on the backing material. Then the layer of backing material is inverted forming a small loop within a narrow space at the front of regulating members above and below the platen and the backing material is peeled off in the rearward direction of the device. The backing material again engages with the feed pins at the lower side surface of the feed roller and is pulled toward the rear of the main body.

With the composite label used according to the P.S.P. system, both the laminated label material and the backing material generally engage with the feed pins of the feed roller so that the printing is performed while the feed flaps of the composite label remain upright. This produces an unsatisfactory printing effect. Since the flaps are upright during printing, the printing types of the printing head can bend the upright flaps and even print the rear sides of the bent flaps, forming unprinted portions on the finished label pieces.

Furthermore, since the label is fed below a label applying roller, which is arranged at the front end of the main body, while the flaps are upright, the feed flaps are still upright when the label piece is applied to the article. This creates an inferior appearance and degrades the quality of the labeled article. The label piece having the upright flaps is easily peeled off the article by means of the upright flaps so that the label may easily be tampered with. Furthermore, when labeled articles in this condition are stacked, a label piece may become adhered to the rear side of the article lying above, by means of the adhesive applied to the rear surface of the label piece below.

SUMMARY OF THE INVENTION

It is, therefore, the principal object of this invention to provide a label arranging device for a label printing machine in which the upraised feed flaps on individual labels are depressed and flattened on the surface of a platen.

A further object of the present invention is to provide a label arranging device for a label printing machine, which enables high quality printing of label pieces and reliable application of printed label pieces.

A still further object of the present invention is to provide a label arranging device, which is simple and compact enough to be made easily at low cost and to be used for a long time without any trouble.

In accordance with the present invention, a composite label arranging device exerts an external force to press the upright feed flaps toward arranging grooves formed upstream of the printing surface of the platen disposed in the feed path of the labels to thereby return the flaps to the flattened condition. The external force is provided by a label arranging member which descends in synchronism with the squeezing operation of a hand lever of the labeling machine.

BRIEF DESCRIPTION OF THE DRAWINGS

The foregoing and other objects and features of the present invention will become apparent from the following description of preferred embodiments taken in connection with the accompanying drawings, in which:

FIGS. 4 and 5 show the arranging operation for the upright flaps of the composite label wherein FIG. 4 is a perspective view showing the condition before arranging and FIG. 5 is a perspective view showing the condition after arranging;

DESCRIPTION OF THE PREFERRED EMBODIMENTS

The first embodiment of the invention is described with reference to FIGS. 1 to 6.

Figure 1:
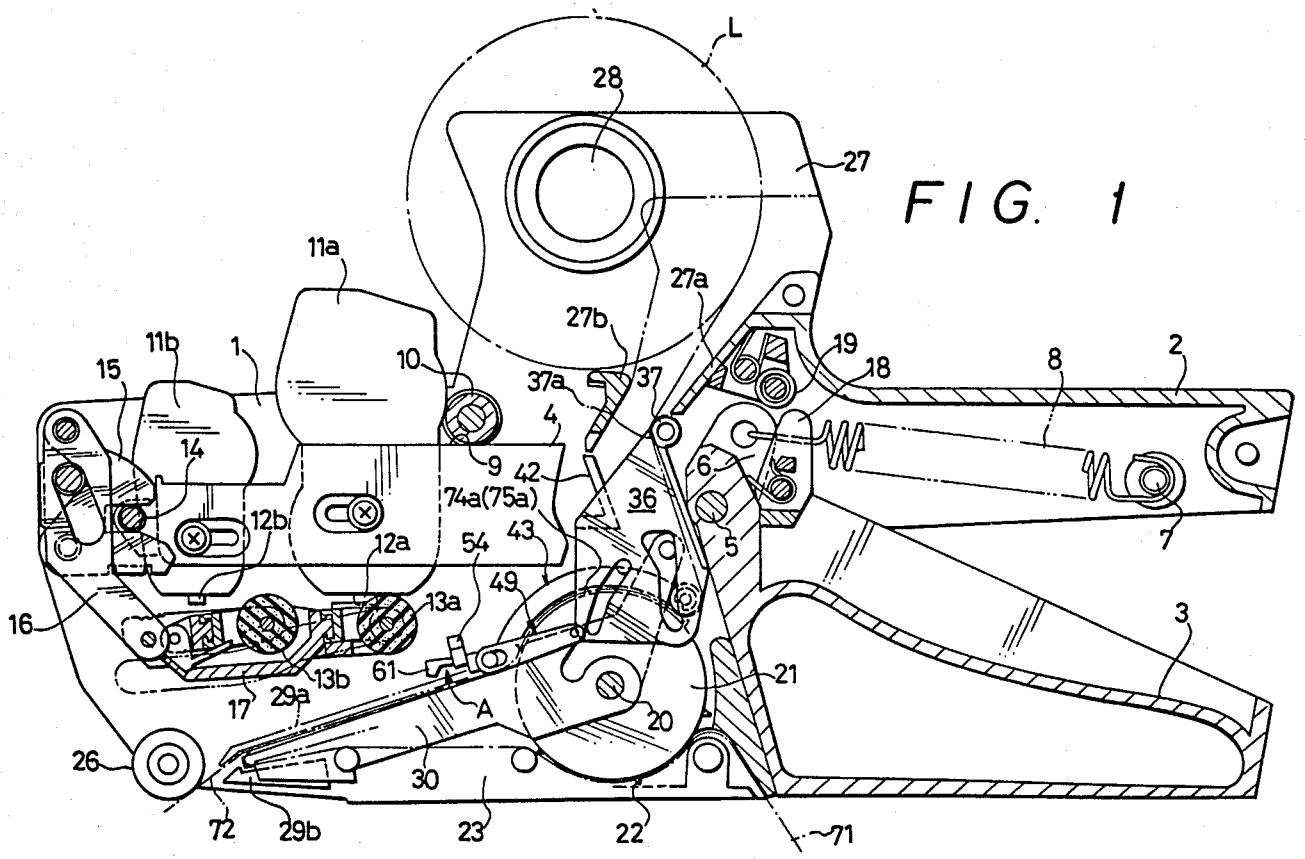
FIG. 1 is a partially cut-away side elevation of a label printing and applying machine having a composite label arranging device according to a first embodiment of the present invention.

Referring to FIG. 1, the labeling machine has a grip lever 2 which extends to the rear (right) of a pair of opposing machine frames 1. A hand lever 3 is arranged in opposition to the grip lever 2 and is pivotally supported on a shaft 5 on the frames. Printing levers 4 mounting printing devices 11*a* and 11*b* extend from the front of the hand lever 3. A spring hook member 6 is attached to the lever 3. A return spring 8 is hooked between the spring hook member 6 and a spring hook member 7 disposed on the grip lever 2. The spring 8 constantly biases the printers 11*a* and 11*b* upward (clockwise) so that the top surface 9 of the printing levers 4 are in stationary contact with a stopper 10 defined on the machine frames 1.

The printing devices 11*a* and 11*b* are provided with desired printing types 12*a* and 12*b* by a known type selecting mechanism, and the types are opposed to a platen 30 to be described later.

Ink rollers 13*a* and 13*b* are supported by an ink roller holder 17 for rollingly applying two colors on the types 12*a* and 12*b*, respectively. The ink rollers are constructed to apply different colors to the types by a guide means of the ink roller and by a link mechanism comprising a starting member 14, a starting cam 15, a link frame 16 and so on.

The machine further includes a constant pressure printing mechanism which comprises a pressing member 18 and a pressure receiving member 19 and which is interposed between the hand lever 3 and the machine frames 1 so that the squeezing of the hand lever 3 results in contact of the printing devices 11*a* and 11*b* with the platen 30 and hence the constant pressure printing.

A tape-like composite label strip L is wound in the form of a roll at a label holding device 28 of a label holder 27. The label strip L engages feed pins 22 arranged at equal intervals on the outer circumference of a cylindrical label strip feed roller 21 that is pivotally supported on a main spindle 20. The label strip is advanced forward on the platen 30 by the intermittent rotation of the label feed roller 21, which rotation is caused by the releasing operation following the squeezing of the hand lever 3.

Figure 6:
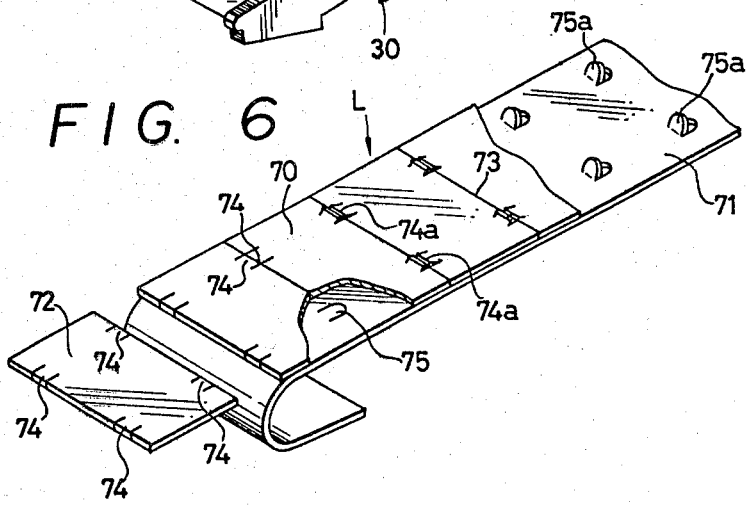
FIG. 6 is a perspective view of the composite label used with the first embodiment of the invention.

The tape-like composite label strip L has the form shown in FIG. 6 and comprises a layer of label material 70 and a layer of backing material 71 which are superposed on each other. Adhesive applied to the rear surface of the label material 70 holds the layers together. A releasing agent is applied to the upper surface of the backing material. Pre-cut lines 73 divide the label material transversely at equal intervals along the longitudinal direction, defining unit label pieces 72 therebetween.

In both of the label material 70 and the tape-like backing material 71, pairs of feed flaps 74 and 75 are formed by feed perforations at longitudinal spacing corresponding to the pitch of the label pieces 72. The feed flaps 74 in the label material 70 comprise two perforations crossing each of the pre-cut lines 73. The feed flaps 75 in the backing material are of U-shape and are positioned to underlie the feed flaps 74. When the feed flaps 74 and 75 engage with the feed pins 22 of the feed roller 21, they are formed into upright flaps 74*a* and 75*a*, respectively.

A label mounting device is set having the label feed roller 21 at the center. It effects the engagement of the tape-like composite label strip L with the label feed roller 21, which causes uplifting of flaps 74*a* and 75*a*.

Figure 2:
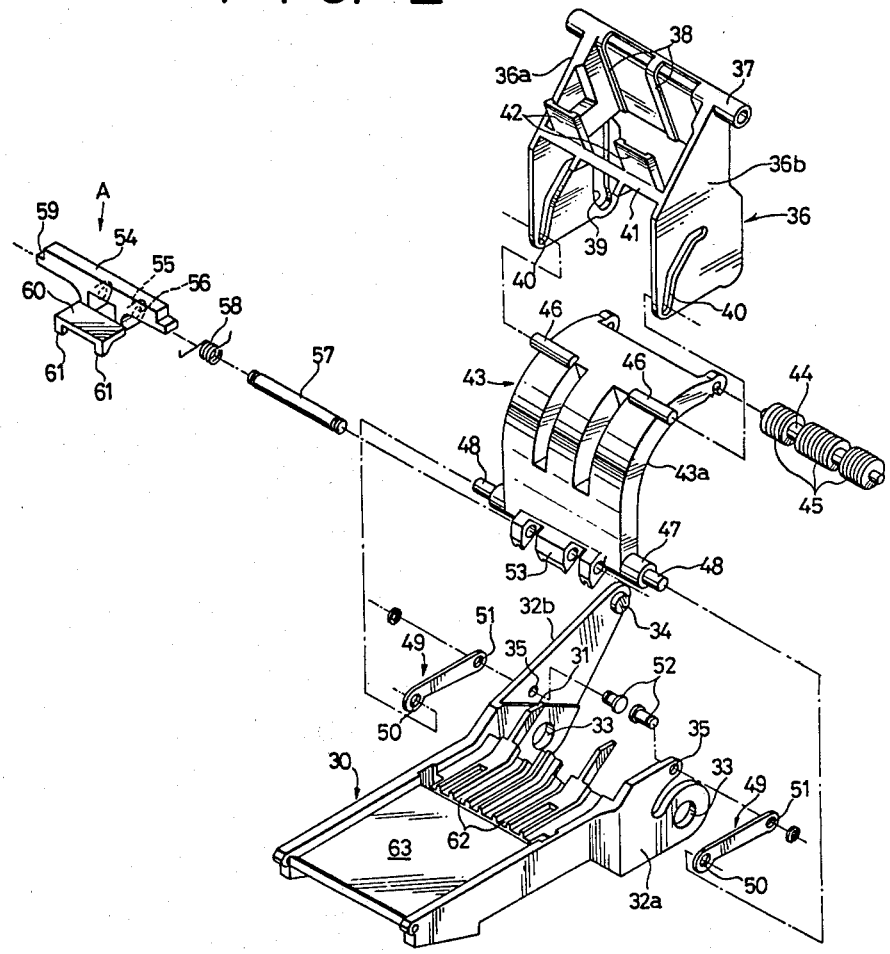
FIG. 2 is an exploded perspective view of the composite label arranging device of the first embodiment.
Figure 3:
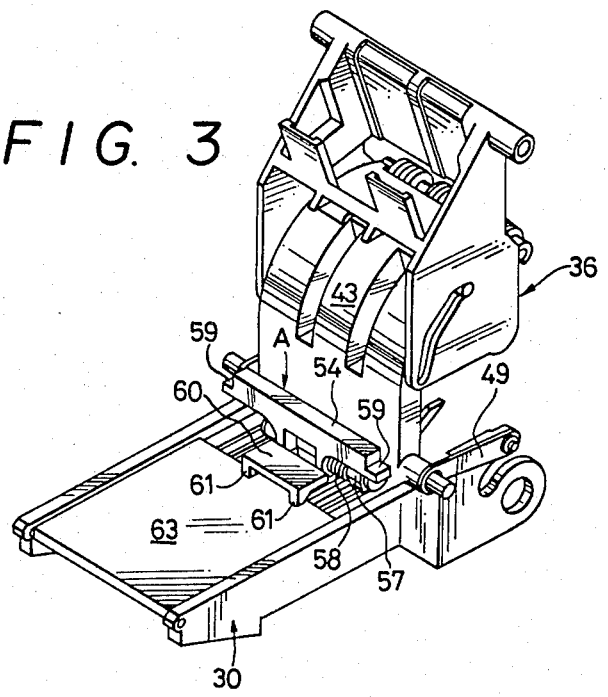
FIG. 3 is a perspective view of the device of the first embodiment in its assembled condition.

As shown in detail in FIGS. 2 and 3, the main elements of the label mounting device are a platen 30, which is rotatably mounted to the machine frames 1 at 33, a rotatable starting member 36 which operates in synchronism with the platen and part of which is pivotally mounted on the machine frames, a label press member 43 operative in synchronism with the starting member, and a pair of link members 49 operative in synchronism with the label press member 43 and the platen 30. All these members are made of synthetic resin materials.

At its rear side, the platen 30 has label guide members 31, a short arm 32*a* at one lateral side, and a long arm 32*b* at the other lateral side. Holes 33 are formed in the arms 32*a* and 32*b* in which is rotatably supported the spindle 20 of the label feed roller 21. An inwardly extending fitting pin 34 projects from the free end of the long arm 32*b*.

The starting member 36 comprises a frame body. Its tubular base 37 is rotatably fitted in fitting grooves 37*a* (FIG. 1) formed in the machine frames 1. Label guide members 38 extend downwardly from the base 37 and their top parts are bent in an arc shape. The member 36 includes a pair of opposed lateral side frame plates 36*a* and 36*b*. An elongate hole 39 is formed in the frame plate 36*a*, which receives the fitting pin 34 of the platen 30. The frame plates 36*a* and 36*b* also have elongate holes 40 in them for receiving fitting pins 46 of the label press member 43, described hereinafter. A support 41 extends across the space between the frame plates 36*a* and 36*b*. L-shaped label stoppers 42 are connected to the support 41.

The label press member 43 comprises an arc-shaped body. At its inner side, there is a concavely arcuate press surface 43*a* shaped and placed for pressing the tape-like label strip L to the outer circumference of the label feed roller 21. Fitting pins 46 fitted in the elongate holes 40 of the starting member 36 project from the upper part of the label press member 43. A roller shaft 44 is held at the upper end of the label press member 43. Label guide rollers 45 are rotatably mounted on the roller shaft 44. Support shafts 48 connected to bases 47 are disposed at both lower ends of the label press member 43.

The paired links 49 each have small elongate holes 50 at one end for receiving the support shafts 48 of the label press member 43 and have connecting holes 51 at the other end for connection with the platen 30. These connecting holes 51 are connected by connecting bolts 52 to mounting holes 35 formed in both arms 32*a* and 32*b* of the platen 30.

A label arranging unit 54 of a label arranging device A of the present invention is mounted to a mount 53 disposed at the front end of the label press member 43. The arranging unit 54 flattens the upright flaps 74*a* and 75*a* in the composite label strip L to the flat condition. The label arranging unit 54 has mounts 55 at its base in which mounting holes 56 are formed. A main spindle 57 is fitted in the holes 56 via a spring 58.

The main spindle 57 is stopped by the mount 53 of the label press member 43 and resiliently biases the label arranging unit 54 toward the opposite direction of the surface of the platen 30. The biasing force of the spring 58 biases the head 60 of the label arranging unit 54 upwardly so that the press legs 61 of the head may be kept separated from the platen 30 and may not contact the surface of the tape-like composite label strip L displaced along the platen 30.

At the upper base of the label arranging unit 54, there are pressure receiving surfaces 59 comprising steps formed with a space between them corresponding to the distance between the printing levers 4. The press legs 61, corresponding in spacing and location to the feed flaps 74 and 75 of the composite label strip L, are provided beneath the head 60.

Label arranging grooves 62 which are adapted to receive the pair of press legs 61 of the label arranging unit 54 are formed on the platen 30. The label arranging grooves 62 are formed adjacent to and just upstream of a printing surface 63 of the platen 30, which is brought into contact with the printing devices 11*a* and 11*b*. The grooves 62 are formed one pitch before the printing surface relative to the advancing direction of the composite label strip L.

The tape-like composite label strip L as shown in FIG. 6 is set within the label printing machine as shown in FIG. 1 for having the respective operations of feeding, printing and peeling of the labels from the backing material performed on the composite label strip. More specifically, the composite label strip L wound in a roll supported on the label holding device 28 passes between label guide pieces 27*a* and 27*b* and is clamped between the outer circumference of the feed roller 21 and the label press member 43 so that the feed flaps 74 and 75 engage with the feed pins 22 of the feed roller 21 and are raised into upright flaps 74*a* and 75*a*.

The tape-like composite label strip L is advanced in steps toward the platen 30 by the feed roller 21 which rotates intermittently counterclockwise in synchronism with the releasing of the hand lever 3 after the squeezing thereof.

The operation of the label arranging device A will now be described with reference to FIGS. 4 and 5. When the upright flaps 74*a* and 75*a* reach above the platen 30, the upright flaps 74*a* and 75*a* are located at the arranging position, which is one pitch before the printing position, through the squeezing of the hand lever 3 which also causes the printing operation on the preceding label piece which is downstream in the path of the label strip.

More specifically, when the printing levers 4 descend upon squeezing of the hand lever 3, the printing levers 4 press upon the pressure receiving surfaces 59 of the label arranging unit 54. Consequently, the label arranging unit 54 pivots the arranging head 60 counterclockwise against the biasing force of the spring 58. This presses the press legs 61 of the arranging head 60 to engage with the arranging grooves 62 of the platen 30, as shown in FIG. 5. Thus, the upright flaps 74*a* and 75*a* located over the platen 30 are pushed into the arranging grooves 62 by the press legs 61 of the label arranging unit 54, and are thereby bent in the opposite direction from the upstanding direction of the upright flaps 74*a* and 75*a*. Flattening of the flaps is thus assured.

Figure 4:
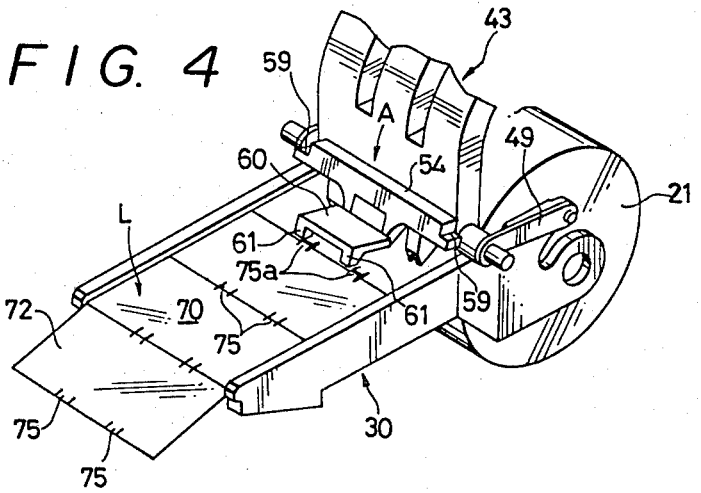
Figure 5:
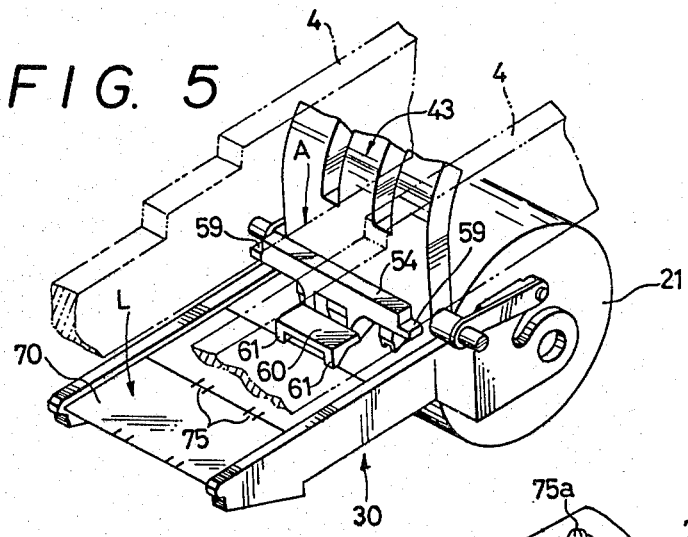

When the printing levers 4 are now separated from the label arranging unit 54 by releasing and spring biased returning of the hand lever 3, the device is also returned to the original condition wherein the head 60 is held up by the biasing force of the spring 58, as shown in FIG. 4.

The unit label piece 72, which has been printed and whose feed flaps 75 have been arranged, slides over and advances over the platen 30 due to the counterclockwise rotation of the feed roller 21 rotating in synchronism with the releasing operation of the hand lever 3. The label piece 72 is then positioned below an applying roller 26 (FIG. 1) following the inversion of the backing material 71 and the label piece is then adhered to an article by the pressing action of the device.

The inversion of the backing material 71 of the composite label strip L near the front end of the platen 30 is performed by forming a small loop with a regulating member 29*a* disposed at the machine frame 1 above and below the platen 30 and a regulating member 29*b* disposed at a bottom lid 23. The unit label piece 72 temporarily adhered to the backing material 71 is separated therefrom during the inversion.

Figure 7:
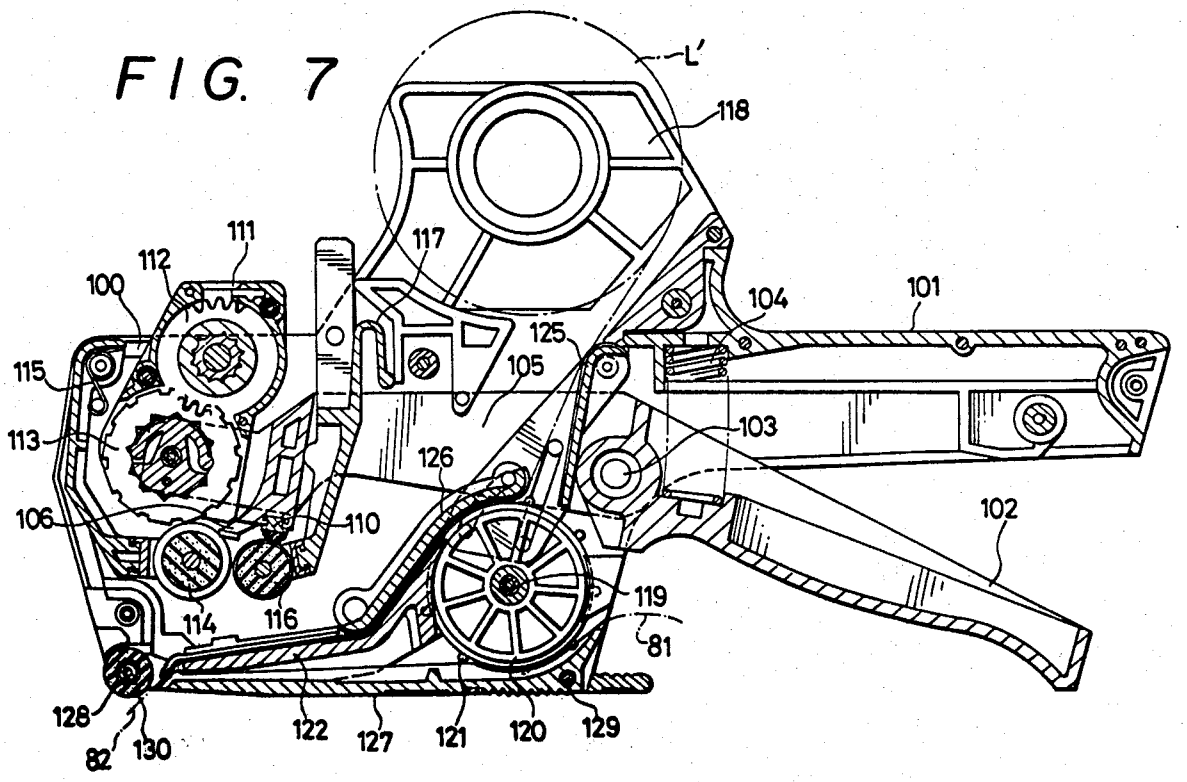
FIG. 7 is a partially cut-away side elevation of a label printing and applying machine having a composite label arranging device according to a second embodiment of the present invention.

The second embodiment of the present invention is now described with reference to FIGS. 7 to 11. Referring to FIG. 7, a spring 104 is interposed between a grip 101 formed integrally with and rearwardly of a pair of machine frames 100 and a hand lever 102 pivotally supported by a spindle 103 on the machine frames 100. The hand lever 102 is returned by the biasing force of the spring 104 upon release of the hand lever following the squeezing of the hand lever 102.

Printing levers 105 extend in branched form at the front of the hand lever 102. At the front ends of the printing levers are mounted a printing device 111 incorporating type wheels 113 and type selecting wheels 112 which are engaged with each other.

Figure 8:
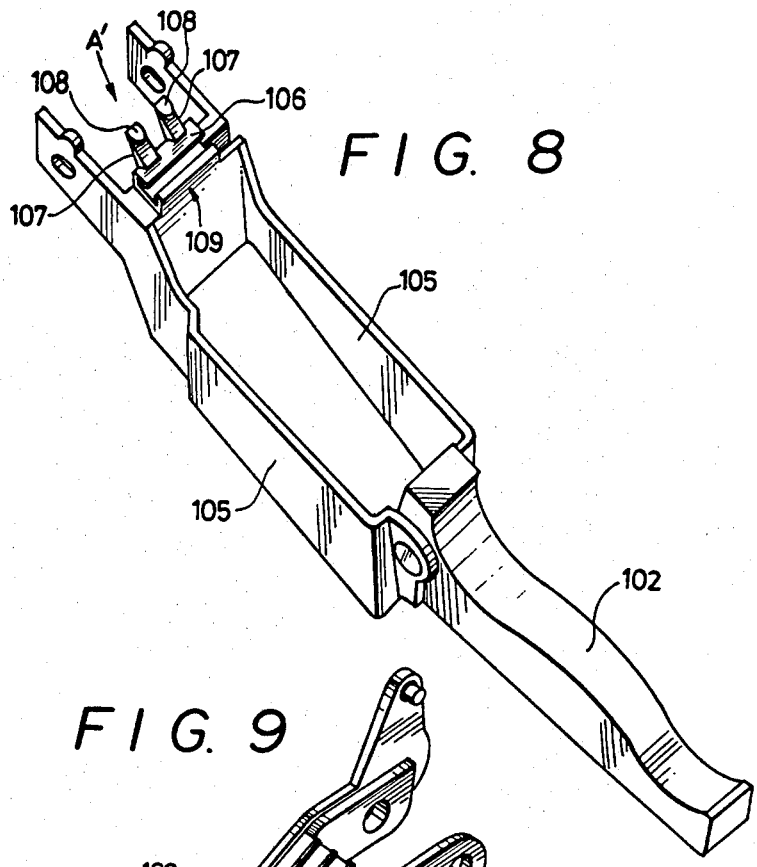
FIG. 8 is a perspective view of a hand lever of the machine having a label arranging member of the second embodiment.

In the branched printing levers 105 shown in FIG. 8, a label arranging device A′ is disposed to be adjacent to and at the lower rear side of the printing device 111. The label arranging device A′ comprises a label arranging member 106 which is supported by the branched printing levers 105 and which is formed integrally therewith. This label arranging member 106 faces downwardly in opposition to a platen 122, and it is inclined along the advancing direction of the composite label strip L′, that is, along the direction of the printing device 111. The label arranging member 106 has a pair of press legs 107 each having a pressing surface 108 at the bottom. The pair of press legs 107 of the label arranging member 106 is preferably so placed and are spaced apart the same width as the two rows of upright flaps 84*a* and 85*a* of the composite label strip L′ of FIG. 11.

A code plate 109 in the form of a dovetail is disposed behind the label arranging device A′. To the plate 109 is attached a detachable character plate 110 for bearing the name of the store, or the name of an article on sale, or the like.

Ink rollers of different colors, for example, a black ink roller 114 and a red ink roller 116, are in contact with the type located below the type wheel 113 of the printer 111 and the character plate 110 located below the code plate 109, respectively.

The base of the ink roller 114 is placed in elastic contact with the corresonding type surface by a spring 115. The base of the ink roller 116 is a curved part 117 of a flexible synthetic resin to cause the roller to be in elastic contact with the corresponding type surface.

A label holder 118 for holding the composite label strip L′ wound in a roll is disposed at the upper part of the machine frames. A main spindle 119 extends across the machine frames 100 at the lower part of the machine. A feed roller 120 having feed pins 121 formed at equal intervals on its outer circumference is mounted on the main spindle 119.

Figure 9:
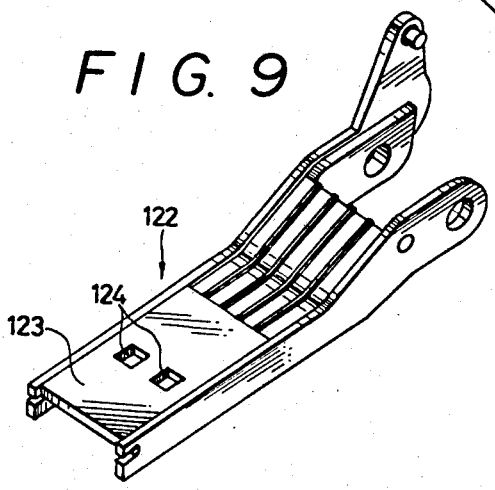
FIG. 9 is a perspective view of the platen of the machine with arranging grooves of the second embodiment.

The base of the platen 112, shown in detail in FIG. 9, is mounted to the main spindle 119. At the flat surface of the platen 122 are formed a pressure-receiving surface 123 for opposing and cooperating with the printing device 111 and the arranging grooves 124 placed for engagement with the pair of press legs 107 of the label arranging device A′.

Referring to FIG. 7, a label press member 126 for covering a label guide member 125 and part of the feed roller 120 is arranged above the feed roller 120. When the composite label is set in the machine, both these members 125 and 126 are displaced in synchronism with the counterclockwise pivoting of the platen 122 to thereby make the insertion of the label smoother and to facilitate the engagement of the composite label strip L′ with the feed roller 120 during the feeding of the labels.

The platen 122 has a bottom lid 127 rotatably mounted on a shaft 128 at the bottom of the platen. This lid is opened for providing access to the labels when the labels are being inserted, and the lid is closed normally by a lock pin 129 disposed at its end.

An applying roller 130 rotatably mounted on the shaft 128 applies a unit label piece 82 of the composite label strip L' to an article.

Figure 11:
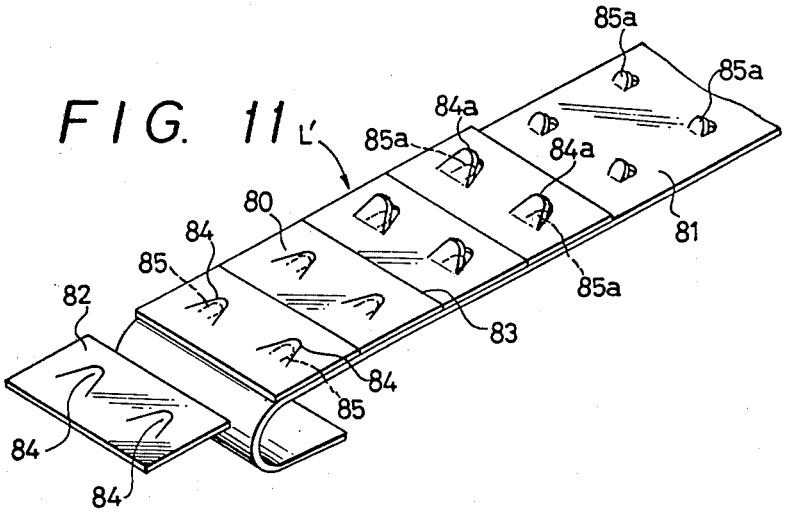
FIG. 11 is a perspective view of the composite label used with the second embodiment of the invention.

The tape-like composite label strip L' used with the label arranging device A' is shown in FIG. 11. It is basically the same as that used with the first embodiment. This label strip L' comprises a layer of label material 80 and a backing material layer 81 which are superposed on each other. A releasing agent is applied to the surface of the backing material 81 and an adhesive is applied to the rear surface of the label material 80. Pre-cut lines 83 transversely cross the layer of label material for providing unit label pieces 82 and are formed at equal intervals along the longitudinal direction of the tape-like label material layer 80. A pair of substantially V-shaped feed flaps 84 are formed between adjacent pre-cut lines 83, that is, within the effective area of the label. A pair of substantially U-shaped feed flaps 85 are formed at corresponding locations on the tape-like backing material 81 underlying the flaps 84. These feed flaps 84 and 85 are upraised into upright flaps 84*a* and 85*a*, respectively, when they engage with the feed pins 121 of the feed roller 120.

Figure 10:
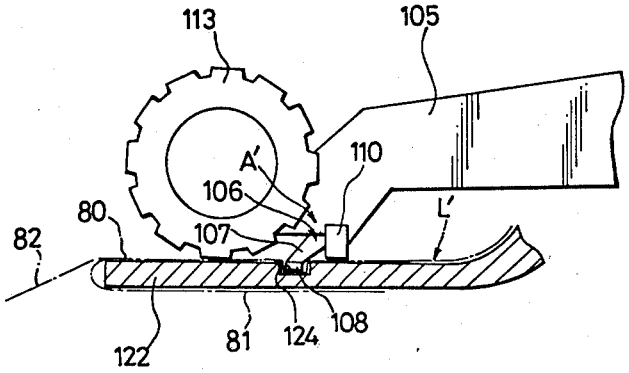
FIG. 10 is a side sectional view showing the arranged condition of the upright flaps formed in the composite label used with the second embodiment of the invention.

The operation of the label arranging device A' is now described with reference to FIGS. 7 and 10. As in the case of the first embodiment, the tape-like composite label strip L' is held by the label holder 118 and the label press member 126 through the label guide member 125. The feed flaps 84 and 85 engage with the feed pins 121 of the feed roller 120, and the leading end of the label strip is guided on the platen 122. This composite label strip L' is formed into a small loop at the front of the platen and is inverted by regulating members located above and below the platen, near the front end of the platen 122. The unit label piece 82 which had been temporarily adhered to the backing material 81 is separated therefrom and is displaced below the applying roller 130. The backing material 81 inverted toward the rear surface of the platen 122 engages with the feed pins 121 on the underside of the feed roller 120 and is guided toward the rear and outside the machine.

The composite label strip L', as it is displaced on the platen 122 has the feed flaps 84 and 85 upraised into the upright flaps 84*a* and 85*a*. The upright flaps 84*a* and 85*a* are arranged flat by the label arranging device A' set one pitch before the printing position.

More specifically, the type of the printing device 111 is brought into contact with the printing surface 123 of the platen 122 during squeezing of the hand lever 102 for performing the desired printing. At the same time, at the position which is one pitch before the printing position, the press legs 107 of the label arranging member 106 are pressed into the arranging grooves 124, forcibly pressing the upright flaps 84*a* and 85*a* and deforming them to the flat position. Flattening of the upright flaps is thus assured.

In accordance with the present invention, the platen having the arranging grooves is opposed to the label arranging member which cooperates with the printing lever descending during squeezing of the hand lever. When arranging the composite label by the engagement of the label arranging member and the arranging grooves of the platen, the upright flaps of the composite label formed by the engagement with the feed pins of the feed roller may be forcibly pressed in the direction opposite to their upstanding condition.

Accordingly, the flattening operation may be certain, the printing effect may be satisfactory, and tampering with the label after its application to the article may be prevented.

Although the present invention has been described in connection with preferred embodiments thereof, many variations and modifications will now become apparent to those skilled in the art. It is preferred, therefore, that the present invention be limited not by the specific disclosure herein, but by the appended claims.

What is claimed is:

1. A label arranging device for use in a label printing and applying machine of the type which includes feed means for advancing a label strip along a feed path, the feed means including feed pins for engaging and raising up feed flaps formed on the label strip, a platen positioned along the feed path downstream from a position at which the feed pins engage the feed flaps, the platen being adapted to support a label of said label strip located at a printing position, a label printing device, including a type opposable to the platen, for engaging and imprinting a label located at the printing position, and a printing lever supporting the printing device, the platen and printing lever being movable relative to one another to permit the type to be moved to the platen and then separated therefrom, the label arranging device comprising:

a groove formed in the platen at an arranging position upstream of the printing position and corresponding to the location of one of the feed flaps when one of the labels of the label strip is located at the printing position;

a label arranging member movable between a first position wherein it is remote from said groove and a second position wherein it is located in said groove such that the label arranging member pushes the feed flap located at the arranging position into the groove and below the plane of the label strip in the area of the groove, the label arranging arranging member being moved from the first to the second position in response to the relative movement of the platen and the printing lever.

2. The label arranging device of claim 1, wherein the label strip is a composite label strip comprised of a layer of backing material and a layer of label material cut into individual labels and superimposed on the backing material layer; the feed flaps being formed in both layers of the composite label strip and associated feed flaps of each layer overlying one another.

3. The label arranging device of claim 1, wherein the arranging member comprises a projection extending toward the platen.

4. The label arranging device of claim 1, wherein the feed means includes a rotatable feed roller having the feed pins located thereon and being rotatable for moving the feed pins.

5. The label arranging device of claim 4, further comprising a press member shaped and positioned for pressing a label strip against the feed roller and the feed pins thereon; and the label arranging device being supported on the press member.

6. The label arranging device of either of claims 1 or 4, further comprising a hand operated lever connected with the printing lever for moving the printing lever; the feed means being connected with the printing lever such that the feed means moves the feed pins to advance the label strip along the feed path as the printing lever relatively moves the printing device away from the platen.

7. The label arranging device of either of claims 1 or 4, wherein the label arranging member moves from the first to the second position upon engagement of the printing lever with the label arranging member as the printing lever moves to the platen, and the label arranging member being movable to the second position as the printing lever moves away from the platen.

8. The label arranging device of either of claims 1 or 4, wherein the label arranging member is attached to and moves together with the printing lever.

9. The label arranging device of claim 4, wherein the label arranging member is positioned between the feed roller and the printing device along the feed path of the label strip.

10. The label arranging device of claim 9, wherein the label arranging member is attached to and moves together with the printing lever.

11. The label arranging device of claim 9, further comprising a hand operated lever connected with the printing lever for moving the printing lever; the feed means being connected with the printing lever, such that the feed means moves the feed pins to advance the label strip along the feed path as the printing lever relatively moves the printing device away from the platen.

12. The label arranging device of claim 9 wherein the label arranging member is moved from the first to the second location upon engagement of the printing lever with the label arranging member as the printing lever moves to the platen, and the label arranging member being moved from the second to the first position as the printing lever moves away from the platen.

13. The label arranging device of claim 12, wherein the label arranging member is supported to be pivoted when engaged by the printing lever.

14. The label arranging device of claim 13, further comprising biasing means for biasing the label arranging member in to the first position.

15. The label arranging device of claim 13, further comprising a press member shaped and positioned for pressing a label strip against the feed roller and the feed pins thereon; and the label arranging device being supported on the press member.

16. The label arranging device of claim 9, wherein the label strip is a composite label strip comprised of a layer of backing material and a layer of label material cut into individual labels and superimposed on the backing material layer; the feed flaps being formed in both layers of the composite label strip and associated feed flaps of each layer overlying one another.

17. The label arranging device of claim 16, further comprising means positioned beyond the platen in the feed path of the label strip for separating the label material from the backing material.

18. The label arranging device of claim 17, wherein the label printing and applying machine further comprises a label applying device for applying individual labels separated from the backing material to articles.

* * * * *